US006969430B2

(12) United States Patent
Van den Sype et al.

(10) Patent No.: US 6,969,430 B2
(45) Date of Patent: Nov. 29, 2005

(54) PROCESS AND APPARATUS FOR PRODUCING ATMOSPHERE FOR HIGH PRODUCTIVITY CARBURIZING

(75) Inventors: Jaak Stefaan Van den Sype, Dobbs Ferry, NY (US); Alan Russell Barlow, Ridgefield, CT (US); Edison Viotto, São Paulo (BR)

(73) Assignee: Praxair Technology, Inc., Danbury, CT (US)

( * ) Notice: Subject to any disclaimer, the term of this patent is extended or adjusted under 35 U.S.C. 154(b) by 80 days.

(21) Appl. No.: 10/162,754

(22) Filed: Jun. 5, 2002

(65) Prior Publication Data

US 2003/0226619 A1 Dec. 11, 2003

(51) Int. Cl.[7] ..... C21D 1/76

(52) U.S. Cl. ..... 148/206; 148/207; 148/215; 148/216

(58) Field of Search ..... 148/206, 207, 148/215, 216

(56) References Cited

U.S. PATENT DOCUMENTS

| | | | | |
|---|---|---|---|---|
| 4,049,472 A | | 9/1977 | Arndt | 148/16 |
| 4,145,232 A | * | 3/1979 | Solomon | 148/218 |
| 4,306,918 A | * | 12/1981 | Kaspersma et al. | 148/218 |
| 4,519,853 A | * | 5/1985 | Kostelitz et al. | 148/216 |
| 5,676,769 A | | 10/1997 | Kawamura et al. | 148/206 |

FOREIGN PATENT DOCUMENTS

WO WO 9955921 10/1999

OTHER PUBLICATIONS

R. Strigl "Carboquick", GASWARME International 45 (1996) p560ff.

T. Naito & K. Ogihara, "Examined the Direct Carburizing Method", Proc. 2nd Intl. Conf. On Carburizing & Nitriding with Atmospheres, Cleveland 1995 p43ff.

N. Kanetake & S. Takahasi, "Carburizing with CO–enriched gas." —Proc. 2nd Intl. Conf. On Carburizing & Nitriding with Atmospheres, Cleveland 1995 p157ff.

* cited by examiner

*Primary Examiner*—Daniel Jenkins

(57) ABSTRACT

This invention is directed to a process and apparatus for producing high productivity carburizing. A process is introduced that uses a gas mixture made up of CO, $H_2$, $CO_2$, $H_2O$, $CH_4$ and $N_2$, such that the product of the % CO and % $H_2$ is greater than about 1600; the ratio of $CO/CO_2$ is greater than 10; and the ratio of $H_2/H_2O$ is greater than about 10. The gas mixture is controlled for a short time. A reactor for generating a gas mixture for carburizing steel is also introduced. This reactor is composed of a cylindrically symmetric body; a first central tube containing electrical heating elements for gas flow; a second central tube concentrically disposed around the first central tube; and a plurality of catalyst beds disposed in an annular space in a segmented fashion around the second central tube.

10 Claims, 1 Drawing Sheet

PROCESS AND APPARATUS FOR PRODUCING ATMOSPHERE FOR HIGH PRODUCTIVITY CARBURIZING

FIELD OF THE INVENTION

This invention relates to a process and apparatus for producing atmospheres for high productivity carburizing. More particularly, this invention is directed to a process and apparatus for producing an atmosphere suitable for accelerated carburizing process using noble metal catalyst.

BACKGROUND OF THE INVENTION

Carburizing is a widely used process for hardening the surface of steel parts by diffusion of carbon into the steel surface at high temperature. The carbon is supplied to the steel surfaces by a carrier gas having a high carbon potential. The most commonly used carburizing gas mixture is an endothermic gas which consists of 20% carbon monoxide (CO), 40% hydrogen ($H_2$) and 40% nitrogen ($N_2$). It is believed that the dominant reaction at the surface of the steel during the carburizing process is:

$$CO+H_2 \text{--->} C_{steel}+H_2O \quad (1)$$

The rate at which carbon is put into the steel is therefore proportional to the product of the CO and $H_2$ concentration in the carrier gas. It is believed that the most productive reactive makeup for the reactant is a 50% CO and 50% $H_2$ mixture. This mixture may decrease the carburizing times by as much as 50%, thereby doubling the furnace productivity. However, there is presently no practical and economical generator available to produce carburizing gas with high percentage of CO and $H_2$. It would therefore be a benefit in the art to provide a process and apparatus for producing carburizing gas with a high percentage of CO and $H_2$.

There have been various attempts in the art to increase the CO and $H_2$ levels during the carburizing process. For example, one method includes direct injection of methanol into the furnace to generate an atmosphere with 33% CO and 67% $H_2$. However, additional thermal load relating to methanol dissociation exists. Furthermore, this method is comparatively very expensive as the atmospheric costs associated with this method is calculated to be about 4.5 times the costs for the endothermic gas.

Another method involves direct injection of methane ($CH_4$) and carbon dioxide ($CO_2$) into the furnace, as in U.S. Pat. No. 5,676,769. Theoretically, this method can generate a 50% CO and 50% $H_2$ mix in the furnace using the reaction:

$$CH_4+CO_2 \text{--->} 2CO+2H_2 \quad (2)$$

This reaction is highly endothermic and requires a catalyst to proceed at the typical carburizing temperature of between about 900° C. to about 960° C. As a result, this makes the process difficult to control, requiring long residence times of the gas in the furnace. Long residence times have the disadvantage of generating $H_2O$ in the furnace while the steel picks up carbon, which in turn keep the carbon potential of the gas phase high. Another disadvantage is that the high methane concentration often leads to excessive soot buildup in the furnace. Therefore, a large amount of methane injection is required to reform the $H_2O$ and keep the carbon potential of the gas phase high. A major drawback to this method is that the high methane concentration often leads to excessive soot buildup in the furnace.

It is desirable to have a method that cures the deficiencies in the prior art. One such method is found in the present application having a high $CO/H_2$ mixture that is prepared in a separate reactor by reforming a $CH_4/CO_2$ mixture over a noble metal catalyst. This avoids the problems associated with direct injection of $CH_4/CO_2$ into the furnace and is significantly less costly than the direct injection of methanol.

SUMMARY OF THE INVENTION

This invention is directed to a process for carburizing steel parts in a furnace comprising introducing into the furnace a gas mixture comprising CO, $H_2$, $CO_2$, $H_2O$, $CH_4$ and $N_2$ such that the product of the % CO and % $H_2$ is greater than about 1600, preferably greater than 2500; the ratio of $CO/CO_2$ is greater than 10; and the ratio of $H_2/H_2O$ is greater than about 10; and controlling the gas mixture in the furnace for less than about 5 minutes, preferably less than 3 minutes, and most preferably less than 1 minute.

In another embodiment, this invention is directed to a process for carburizing steel parts in a furnace comprising introducing into the furnace a gas mixture comprising CO, $H_2$, $CO_2$, $H_2O$, $CH_4$ and $N_2$ such that the product of the % CO and % $H_2$ is greater than about 1600, preferably greater than about 2500; the ratio of $CO/CO_2$ is greater than 10; and the ratio of $H_2/H_2O$ is greater than about 10, the gas mixture being generated by a mixture of $CH_4$ and $CO_2$ over a noble gas catalyst, preferably platinum or rhodium, on an metallic carrier, preferably alumina carrier, at the temperature range of between about 850° C. and 950° C.; and controlling the gas mixture in the furnace for less than about 5 minutes.

In yet another embodiment, this invention is directed to a reactor for generating a gas mixture for carburizing steel which comprises a cylindrically symmetric body; a first central tube containing electrical heating elements for gas flow; a second central tube concentrically disposed around the first central tube; and a plurality of catalyst beds disposed in an annular space in a segmented fashion around the second central tube. There may be six catalyst beds disposed in an annular space in a segmented fashion around the second central tube. The electrical heating elements maintain the gas mixture about 850° C. to about 950° C.

BRIEF DESCRIPTION OF THE DRAWINGS

Other objects, features and advantages will occur to those skilled in the art from the following description of preferred embodiments and the accompanying drawings, in which.

DETAILED DESCRIPTION OF THE PREFERRED EMBODIMENT

Figure 1:
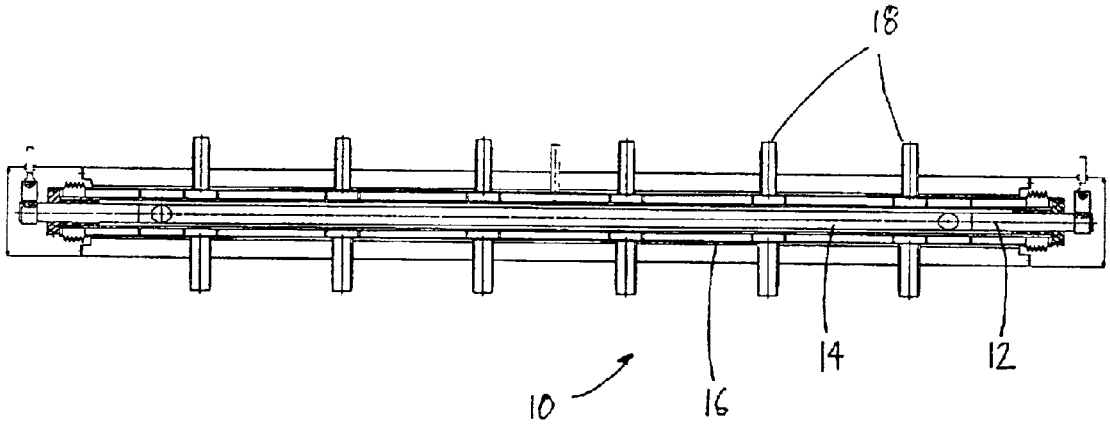
FIG. 1 is a drawing of the reactor for use in this invention.

This invention involves a process for carburizing steel parts in the temperature range of 900° C. to 960° C. in which the rate of carburization is enhanced by:

1. introducing into the furnace a gas mixture having CO, $H_2$ $CO_2$, $H_2O$, $CH_4$ and $N_2$, such that the product (% CO)*(% $H_2$) is greater than 1600, preferably greater than 1200, and the ratio of $CO/CO_2$ and $H_2/H_2O$ in the gas mix is greater than 10. This combination provides a gas with a high carbon potential and thereby minimizes the need for extensive reforming of $CO_2$ and $H_2O$ in the furnace by injection of enriching gas ($CH_4$ or Propane). This process is believed to avoid furnace sooting.

2. The residence time of the gas mixture in the furnace is kept short, preferably less than 5 minutes, more preferably less than 3 minutes, and most preferably about 1 minute. This process effectively purges the furnace of the $H_2O$ generated by combining CO and $H_2$, and again minimizes the need for large amounts of enriching gas.

3. The gas mixture is economically produced in a novel generator. In this generator, mixtures of $CH_4$ and $CO_2$, with possible additions of $O_2$, air and/or electrical heat, are introduced over a noble metal catalyst, preferably platinum or rhodium, on an alumina carrier in the temperature range of between 850° C. to 950° C. Palladium and iridium are alternative noble metal catalyst. Silica and zeolite are alternative supports.

For (% CO)*(% H2)=1600, the carbon transfer rate is about 70% higher than for conventional endothermic gases, where (% CO)*(% $H_2$)=800. $CO/CO_2$ and $H_2/H_2O$ ratios >10 are believed to limit the amount of reforming to be done in the furnace via direct injection of additional methane. This non-catalytic reforming inside the furnace is a slow reaction thereby requiring longer gas residence time. This leads to difficulties in maintaining high carbon potentials and also increases the likelihood of sooting.

EXAMPLE 250 kg. of 16 $MnCr_5$ steel was carburized in an Ipsen T-7 batch furnace at 930° C. A carburizing gas mixture containing about 44% CO and 52% $H_2$ (balance $CO_2$, $H_2O$ and residual $CH_4$) was produced in a catalytic reactor according to invention Method 1 below with x being about 0.4 (24% $O_2$, 34% $CO_2$, balance $CH_4$). The (% CO)*(% $H_2$) is about 290. In the furnace, the % CO was 44%, $CO_2$ was 0.5%, and the initial carbon potential of about 1.4.

The carbon potential was easily controlled without sooting on an $O_2$ probe and via injection of propane or air. Carburizing was for 3 hours at 930° C. followed by 10 minutes at 870° C. (diffusion step). The observed case depth was 1 mm.

A comparison test was done using direct injection of methanol+$N_2$ with % CO in the furnace being 25%, therefore (% CO)*(% $H_2$) is about 1250, as in the prior art. The observed case depth was 0.7 mm, which indicates that the case depth in the inventive process could reduce the carburizing time by about 50%.

High $CO/H_2$ mixtures are prepared in a separate reactor by reforming a $CH_4/CO_2$ mixture over a noble metal catalyst. This avoids control problems associated with direct injection of $CH_4/CO_2$ into the furnace.

Three methods have been identified for preparing the gas mixture:

Method 1: $CH_4$+$CO_2$ with $O_2$ Addition

When mixtures of $CH_4$, $CO_2$ and $O_2$ are introduced over the catalyst, the overall reaction can be described by $$CH_4+x/2\ O_2+(1-x)\ CO_2 \text{--->} (2-X)CO+2H_2 \quad (3)$$

Carburizing gas compositions achievable with reaction (3) are given in the following Table 1.

TABLE 1

| x | % CO | % $H_2$ | % $N_2$ | (% CO) × (% $H_2$) | Req. Heat Input (kWh.CCF endo) | Ad. Temp. Rise (° C.) |
|---|---|---|---|---|---|---|
| 0.0 | 50.0 | 50.0 | 0.0 | 2500 | 2.021 | endothermic |
| 0.2 | 47.4 | 52.6 | 0.0 | 2493 | 1.640 | endothermic |
| 0.4 | 44.4 | 55.6 | 0.0 | 2469 | 1.217 | endothermic |
| 0.6 | 41.2 | 58.8 | 0.0 | 2422 | 0.745 | endothermic |
| 0.8 | 37.5 | 62.5 | 0.0 | 2344 | 0.214 | endothermic |
| 0.9 | 35.5 | 64.5 | 0.0 | 2289 | −0.078 | 107.0 |
| 1.0 | 33.3 | 66.7 | 0.0 | 2222 | −0.388 | 431.1 |

The most desirable composition for a rapid carburizing process is when x=0 (50% CO, 50% H2). Because reaction (1) is highly endothermic ($\Delta H$=−59 kcal/mol $CH_4$), addition of $O_2$ to the reaction mix can significantly reduce the required heat input. The disadvantage in this method is that two oxidants are required ($O_2$ and $CO_2$).

Method 2: $CH_4$+$CO_2$ with Air Addition

Alternatively, air can also be added to the $CO_2/CH_4$ mix. The overall reaction on the catalyst is then described by:

$$CH_4+(x/2)\ (O_2+3.77N_2)+(1-x)CO_2 \text{--->} (2-x)CO+2H_2+1.885N_2 \quad (4)$$

The achievable carburizing gas compositions with reaction (4) are given in the following Table 2.

TABLE 2

| x | % CO | % $H_2$ | % $N_2$ | (% CO) × (% $H_2$) | Req. Heat Input (kWh.CCF endo) | Ad. Temp. Rise (° C.) |
|---|---|---|---|---|---|---|
| 0.0 | 50.0 | 50.0 | 0.0 | 2500 | 2.021 | endothermic |
| 0.2 | 43.1 | 47.9 | 9.0 | 2063 | 1.492 | endothermic |
| 0.4 | 36.7 | 45.9 | 17.3 | 1688 | 1.006 | endothermic |
| 0.6 | 30.9 | 44.1 | 25.0 | 1364 | 0.559 | endothermic |
| 0.8 | 25.5 | 42.5 | 32.0 | 1083 | 0.145 | endothermic |
| 0.9 | 22.9 | 41.7 | 35.4 | 956 | −0.050 | 78.1 |
| 1.0 | 20.5 | 40.9 | 38.6 | 838 | −0.238 | 275.1 |

Method 3: In-situ $CO_2$ Generation

A convenient method of producing gas mixtures with high (% CO)*(% $H_2$) product values is to first combust natural gas with $O_2$ as in step 1 below. Part of all of the water is removed and the remainder $CH_4/CO_2/H_2O$ mixture is reformed over a noble metal catalyst as in step 2.

$$(x/2)CH_4+xO_2 \text{--->} (x/2)CO_2+xH_2O \quad \text{(step 1)}$$

$$(1-(x/2))CH_4+(x/2)CO_2+(1-x)H_2O \text{--->} CO+(3-2x)H_2 \quad \text{(step 2)}$$

The achievable gas compositions with this method are listed in Table 3 below.

TABLE 3

| x | % CO | % $H_2$ | % $N_2$ | (% CO) × (% $H_2$) | Req. Heat Input (kWh/CCF endo) | Adiabatic Temp. Rise (° C.) |
|---|---|---|---|---|---|---|
| 0.50 | 33.3 | 66.7 | 0.0 | 2222 | −0.388 | 431 |
| 0.55 | 34.5 | 65.5 | 0.0 | 2259 | −0.724 | 687 |
| 0.60 | 35.7 | 64.3 | 0.0 | 2296 | −1.084 | 873 |
| 0.65 | 37.0 | 63.0 | 0.0 | 2332 | −1.470 | 1006 |
| 0.70 | 38.5 | 61.5 | 0.0 | 2367 | −1.885 | 1101 |
| 0.75 | 40.0 | 60.0 | 0.0 | 2400 | −2.334 | 1171 |
| 0.80 | 41.7 | 58.3 | 0.0 | 2431 | −2.821 | 1225 |
| 0.85 | 43.5 | 56.5 | 0.0 | 2457 | −3.350 | 1266 |
| 0.90 | 45.5 | 54.5 | 0.0 | 2479 | −3.927 | 1300 |
| 0.95 | 47.6 | 52.4 | 0.0 | 2494 | −4.558 | 1327 |
| 1.00 | 50.0 | 50.0 | 0.0 | 2500 | −5253 | 1350 |

Note that the combustion in $O_2$ always supplies sufficient heat to drive the reforming reactions. The amount of water to be removed after complete combustion of the natural gas is (2x−1) moles per mole of total methane used. This is illustrated in Table 4 below.

TABLE 4

| x | mols $H_2O$/mol $CH_4$ (to be removed) | % $H_2O$ in oxidant to reformer | dewpoint in oxidant to reformer (° F.) |
|---|---|---|---|
| 0.50 | 0.00 | 66.67 | 192 |
| 0.55 | 0.10 | 62.07 | 189 |
| 0.60 | 0.20 | 57.14 | 185 |
| 0.65 | 0.30 | 51.85 | 181 |
| 0.70 | 0.40 | 46.15 | 175 |
| 0.75 | 0.50 | 40.00 | 169 |
| 0.80 | 0.60 | 33.33 | 161 |
| 0.85 | 0.70 | 26.09 | 151 |
| 0.90 | 0.80 | 18.18 | 136 |
| 0.95 | 0.90 | 9.52 | 113 |
| 1.00 | 1.00 | 0.00 | −460 |

The apparatus required to implement this method is described below.

Generally, to obtain the compositions in this invention, and to avoid soot deposition on the catalyst, the catalyst temperature should not drop below about 800° C. Since the reaction is endothermic, this requires a reactor of a special type. FIG. 1 provides an example of such a reactor. The reactor 10 is preferably cylindrically symmetric. A central tube 12 is provided which contains electrical heating elements 14 or in which combustion gases flow in countercurrent with the $CH_4/CO_2/O_2$ or air mix. This mix is introduced into the reactor in the annular space defined by a second tube 16 concentrically disposed around the central tube. Ten catalyst beds 18 are disposed in this annular space in a segmented fashion. The catalyst beds are in the shape of doughnuts and the spacing between them is such that the central tube 12 reheats the reacting gases to about 900° C. before they contact the next catalyst bed. The gas mixture introduced to the reactor is preheated to about 900° C. using a conventional gas to gas heat exchanger using the exit gas from the reactor and/or combustion gases from the reactor. Electrical heat can also be used for preheating the gas mix. Six catalyst beds 18 and electrical heating in the central tube 12 is suitable, although any number of catalyst beds are believed to be operational. Another preferred embodiment is the use of ten catalyst beds. Preferably, the electrical heating elements maintain the temperature of the gas mixture between about 750° C. to about 1050° C., more preferably between about 800° C. to about 1000° C., and most preferably between about 850° C. to about 950° C.

Figure 2:
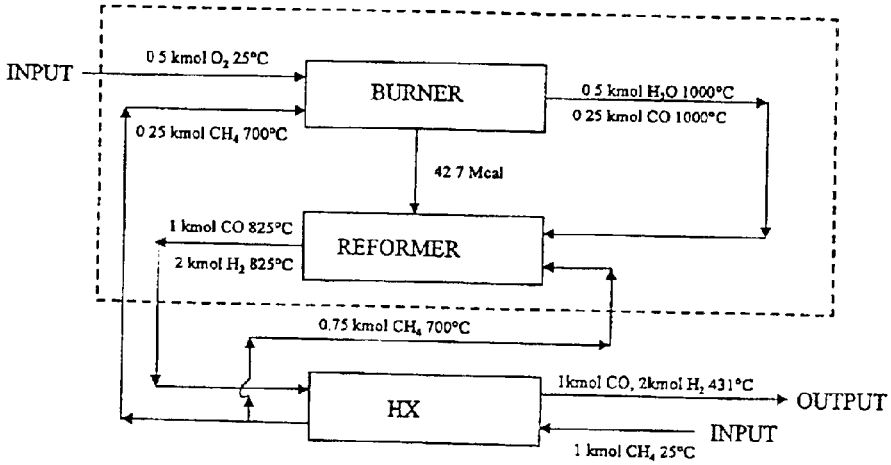
FIG. 2 is a schematic flow diagram of the mass and heat flow for Method 3 (see below) in this invention, where x=0.5 (no intermediate water removal).

A schematic example of mass and heat flows for Method 3 with x=0.5 (no intermediate water removal) is shown in FIG. 2. For x>0.5, some or all of the water at the exit of the burner must be removed, preferably by cooling the gas stream to the temperatures indicted in the last column of Table 4. The gas stream is then reheated using an additional heat exchanger.

The control of the accelerated carburizing process can be done by conventional means. For example, such means may include oxygen probes, $CO/CO_2$ measurements or $H_2O$ measurements. In all three methods, the CO level must be measured in the furnace since the percent of CO in the furnaces is typically in excess of 30% and may vary. During the initial phase of the decarburizing process, the carbon potential is set to equal or exceed the solubility of carbon in austenitic phase of the alloy being treated. Typically, this can be up to about 1.4%. This results in rapid saturation of the surface with carbon. During the diffusion phase of the carburizing process, the carbon potential in the gas phase can be lowered to match the desired surface carbon level (e.g., 0.8% C) in the part being treated. This lower carbon level can be conveniently achieved in the accelerated carburizing gas by dilution with $N_2$.

Those skilled in the art will recognize that numerous changes may be made to the process described in detail herein, without departing in scope or spirit from the present invention as more particularly defined in the claims below.

What is claimed is:

1. A process for carburizing steel parts in a furnace comprising a. introducing into said furnace a gas mixture comprising CO, $H_2$, $CO_2$, $H_2O$, $CH_4$ and $N_2$ such that the product of the % CO and % $H_2$ is greater than about 1600; the ratio of $CO/CO_2$ is greater than 10; and the ratio of $H_2/H_2O$ is greater than about 10; and b. controlling the gas mixture in said furnace for less than about 5 minutes.

2. The process of claim 1 wherein said product of % CO and % $H_2$ is greater than about 2500.

3. The process of claim 1 wherein said gas mixture is controlled in the furnace for less than about 3 minutes.

4. The process of claim 3 wherein said gas mixture is controlled in the furnace for less than about 1 minute.

5. A process for carburizing steel parts in a furnace comprising a. introducing into said furnace a gas mixture comprising CO, $H_2$, $CO_2$, $H_2O$, $CH_4$ and $N_2$ such that the product of the % CO and % $H_2$ is greater than about 1600, the ratio of $CO/CO_2$ is greater than 10, and the ratio of $H_2/H_2O$ is greater than about 10; said gas mixture being generated by a mixture of $CH_4$ and $CO_2$ over a noble gas catalyst on an metallic carrier at the temperature range of between about 850° and 950° C.; and b. controlling the gas mixture in said furnace for less than about 5 minutes.

6. The process of claim 5 wherein said product of % CO and % $H_2$ is greater than about 2500.

7. The process of claim 5 wherein said noble gas catalyst is platinum.

8. The process of claim 5 wherein said noble gas catalyst is rhodium.

9. The process of claim 5 wherein said metallic carrier is an alumina carrier.

10. The process of claim 5 wherein said gas mixture is generated by a reactor that comprises a cylindrically symmetric body; a first central tube containing electrical heating elements for gas flow; a second central tube concentrically disposed around said first central tube; and a plurality of catalyst beds disposed in an annular space in a segmented fashion around said second central tube.

* * * * *